US009565917B2

(12) United States Patent
Lin

(10) Patent No.: US 9,565,917 B2
(45) Date of Patent: Feb. 14, 2017

(54) EYE SHADOW PENCIL CASE

(71) Applicant: Hsiao-Yun Lin, Lukang Township, Changhua County (TW)

(72) Inventor: Hsiao-Yun Lin, Lukang Township, Changhua County (TW)

( * ) Notice: Subject to any disclaimer, the term of this patent is extended or adjusted under 35 U.S.C. 154(b) by 226 days.

(21) Appl. No.: 14/450,691

(22) Filed: Aug. 4, 2014

(65) Prior Publication Data

US 2015/0050067 A1 Feb. 19, 2015

(30) Foreign Application Priority Data

Aug. 14, 2013 (CN) ..... 2013 2 0494700 U

(51) Int. Cl.

| | |
|---|---|
| ***A45D 33/00*** | (2006.01) |
| ***B43K 8/03*** | (2006.01) |
| ***A45D 33/04*** | (2006.01) |
| ***A45D 33/10*** | (2006.01) |
| ***A45D 33/16*** | (2006.01) |
| ***A45D 33/02*** | (2006.01) |
| ***A45D 34/04*** | (2006.01) |

(52) U.S. Cl.

CPC ..... *A45D 34/04* (2013.01); *A45D 2200/1009* (2013.01)

(58) Field of Classification Search

CPC ..... A45D 33/00; A45D 33/04; A45D 33/08; A45D 33/01; A45D 33/16; A45D 33/02; A45D 34/04; B43K 8/003

USPC ..... 401/202, 172, 200

See application file for complete search history.

(56) References Cited

U.S. PATENT DOCUMENTS

| | | | | | |
|---|---|---|---|---|---|
| 1,588,870 | A * | 6/1926 | Aulbach | A45D 33/08 | 222/516 |
| 1,612,593 | A * | 12/1926 | MacDougall | A45D 33/04 | 132/298 |
| 2,173,600 | A * | 9/1939 | Thompson | A45D 40/06 | 401/116 |
| 2,508,164 | A * | 5/1950 | Hopgood | A45D 40/06 | 401/61 |
| 3,083,822 | A * | 4/1963 | Clark | A45D 40/06 | 401/74 |
| 4,380,402 | A * | 4/1983 | Andrews | A45D 40/06 | 401/74 |
| 5,302,042 | A * | 4/1994 | Ackermann | A45D 40/12 | 401/74 |
| 6,009,885 | A * | 1/2000 | Nam | A45D 33/006 | 132/293 |

(Continued)

*Primary Examiner* — Mark A Laurenzi
*Assistant Examiner* — Thomas M Abebe

(57) ABSTRACT

An eye shadow pencil case includes a container for receiving eye shadow, a rotatable control tube, and a makeup tool for applying the eye shadow. The container includes a top end having a first opening. A sliding groove is formed in an intermediate portion of an outer periphery of the container and includes an open position and a closed position. The rotatable control tube includes a top end having a second opening. The rotatable control tube further includes an inner periphery having a protrusion. The protrusion slides in the sliding groove when the rotatable control tube is rotated. The second opening is aligned with the first opening when the protrusion is in the open position. The second opening is not aligned with the first opening when the protrusion is in the closed position. The makeup tool is mounted on the top end of the rotatable control tube.

7 Claims, 5 Drawing Sheets

(56) References Cited

U.S. PATENT DOCUMENTS

| | | | | |
|---|---|---|---|---|
| 6,418,939 | B1 * | 7/2002 | Byun | A45D 33/00 132/313 |
| 8,047,214 | B2 * | 11/2011 | Thorpe | A45D 33/02 132/299 |
| 8,387,627 | B2 * | 3/2013 | Yeom | A45D 33/04 132/299 |
| 9,125,472 | B2 * | 9/2015 | Lin | A45D 33/06 |
| 2004/0120753 | A1 * | 6/2004 | Gieux | A45D 33/02 401/200 |
| 2005/0188999 | A1 * | 9/2005 | Byun | A45D 34/02 132/313 |
| 2008/0178903 | A1 * | 7/2008 | Thorpe | A45D 33/16 132/307 |
| 2008/0264440 | A1 * | 10/2008 | Thorpe | A45D 33/02 132/299 |
| 2008/0276956 | A1 * | 11/2008 | Cho | A45D 33/006 132/294 |
| 2009/0188518 | A1 * | 7/2009 | Thorpe | A45D 33/003 132/307 |
| 2011/0091264 | A1 * | 4/2011 | Zhang | A45D 34/04 401/139 |
| 2011/0126851 | A1 * | 6/2011 | Yeom | A45D 33/04 132/293 |
| 2012/0125361 | A1 * | 5/2012 | Yeom | A45D 33/26 132/293 |
| 2015/0250287 | A1 * | 9/2015 | Yoo | A45D 33/04 401/130 |

* cited by examiner

EYE SHADOW PENCIL CASE

BACKGROUND OF THE INVENTION

The present invention relates to a cosmetic tool and, more particularly, to an eye shadow pencil case.

Eye shadow pencils are widely used in makeup and maintenance of human eye portions. New eye shadow pencil products continually emerge into the market and generally have slight differences in the appearances of the eye shadow pencil cases. Improvement to the internal structure of the eye shadow pencil cases is ignored. An eye shadow pencil case generally includes an eye shadow container having an end in which a sponge for makeup is mounted. The sponge directly contacts the eye shadow in the eye shadow container. The eye shadow directly permeates into the sponge, and the sponge containing the eye shadow can be used for makeup of the human eye portions. However, the case for receiving such an eye shadow pencil has some disadvantages. Specifically, whether the eye shadow pencil is in use or not, the eye shadow always contacts the sponge such that the concentration of the eye shadow in the sponge is too high due to long-term permeation, which is not suitable for light makeup. Furthermore, the eye shadow is wasted in a non-use state. Furthermore, the eye shadow pencil case is a disposable product such that the eye shadow pencil case is discarded when the eye shadow in the eye shadow pencil is used up. Thus, improvement to the eye shadow pencil case is desirable.

BRIEF SUMMARY OF THE INVENTION

An objective of the present invention is to provide an eye shadow pencil case allowing economic use of the eye shadow to solve the disadvantages of the prior art.

To fulfill the above objective, an eye shadow pencil case according to the present invention includes a container adapted for receiving eye shadow, a rotatable control tube, and a makeup tool adapted for applying the eye shadow. The container includes a top end having a first opening. The container includes a sliding groove in an intermediate portion of an outer periphery of the container. The rotatable control tube includes a top end having a second opening. The rotatable control tube further includes an inner periphery having a protrusion. The protrusion of the rotatable control tube is slideably received in the sliding groove of the container. The sliding groove includes an open position and a closed position. The protrusion of the rotatable control tube slides in the sliding groove when the rotatable control tube is rotated. The second opening of the rotatable control tube is aligned with the first opening of the container when the protrusion is in the open position. The second opening of the rotatable control tube is not aligned with the first opening of the container when the protrusion is in the closed position. The makeup tool is mounted on the top end of the rotatable control tube.

The sliding groove can include two ribs separating the sliding groove into a left sliding groove section, a middle sliding groove section, and a right sliding groove section. The second opening of the rotatable control tube is not aligned with the first opening of the container when the protrusion of the rotatable control tube is in the left sliding groove section or the right sliding groove section. The second opening of the rotatable control tube is aligned with the first opening of the container when the protrusion of the rotatable control tube is in the middle sliding groove section.

The makeup tool can be a sponge mounted to the top end of the rotatable control tube.

A support can be mounted between the sponge and the rotatable control tube. The support supports the sponge and includes an upper end having a plurality of notches.

The container can include an upper receiving tube and a lower receiving tube. The upper receiving tube includes the sliding groove and the second opening. The upper receiving tube includes a lower end having an inner thread. The lower receiving tube includes an upper end having an outer thread. The inner thread is threadedly engaged with the outer thread.

A plug can be mounted between the upper receiving tube and the lower receiving tube. The plug seals a connection area between the upper receiving tube and the lower receiving tube.

A cap can be mounted around an outer periphery of the rotatable control tube. The cap can include an inner periphery having an annular groove. The outer periphery of the rotatable control tube can include an annular rib. The annular rib of the rotatable control tube is engaged in the annular groove of the cap when the cap is mounted around the rotatable control tube.

The eye shadow pencil case according to the present invention provides advantageous effects. The container receives eye shadow for makeup purposes. In use, the rotatable control tube is rotated, and the protrusion on the inner periphery of the rotatable control tube slides in the sliding groove in the outer periphery of the container. When the rotatable control tube is rotated to a position, the second opening of the rotatable control tube is aligned with the first opening of the container. In this case, the eye shadow in the container can flow from the first opening and permeate into the makeup tool on the top end of the rotatable control tube. The makeup tool can directly contact the skin at an eye portion for makeup purposes. After makeup, the rotatable control tube is rotated again until the second opening of the rotatable control tube is not aligned with the first opening of the container. Thus, the first opening is sealed to assure that the eye shadow in the container will not flow out of the first opening when not in use. By using the rotatable control tube that can be rotated to open and close the first opening of the container, it is assured that the eye shadow in the container can flow out of the container when in use and that the eye shadow in the container will be retained in the sealed container when not in use, permitting economical use of the eye shadow, which is a reasonable arrangement.

The present invention will become clearer in light of the following detailed description of illustrative embodiments of this invention described in connection with the drawings.

DETAILED DESCRIPTION OF THE INVENTION

Figure 1:
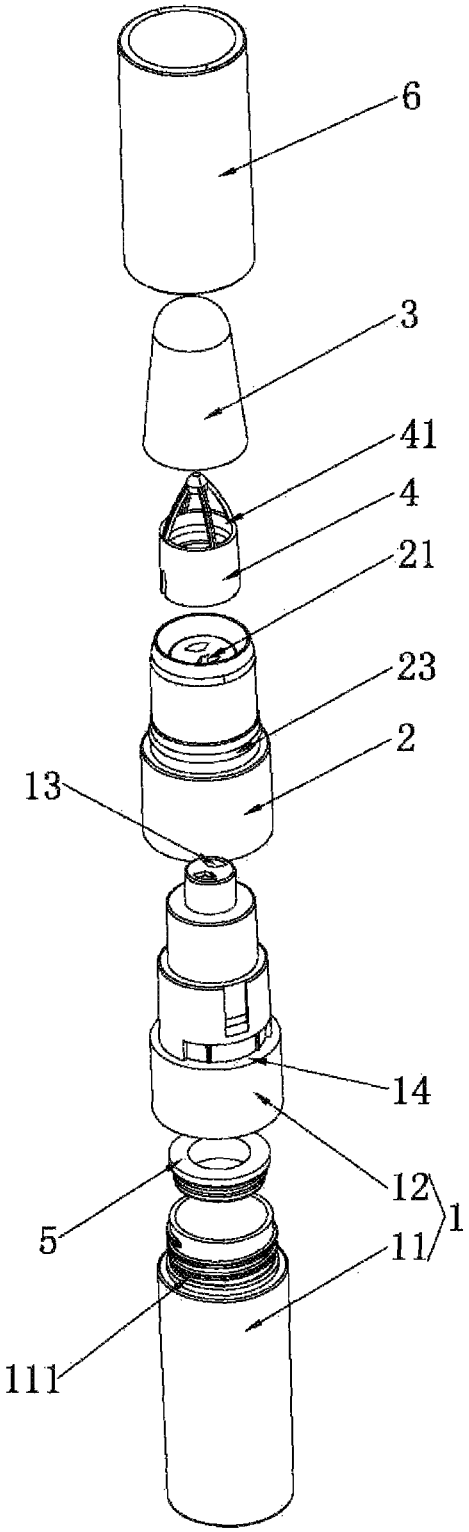
FIG. 1 is an exploded, perspective view of an eye shadow pencil case according to the present invention.
Figure 2:
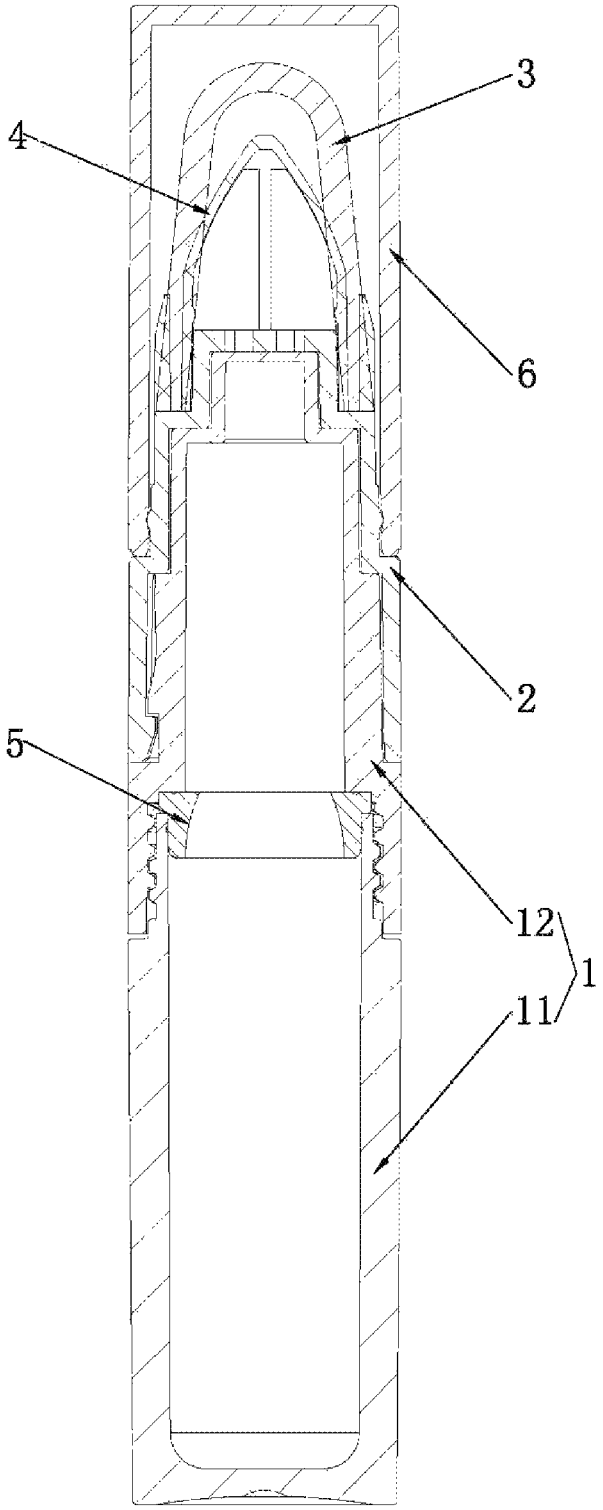
FIG. 2 is a cross sectional view of the eye shadow pencil case according to the present invention.
Figure 3:
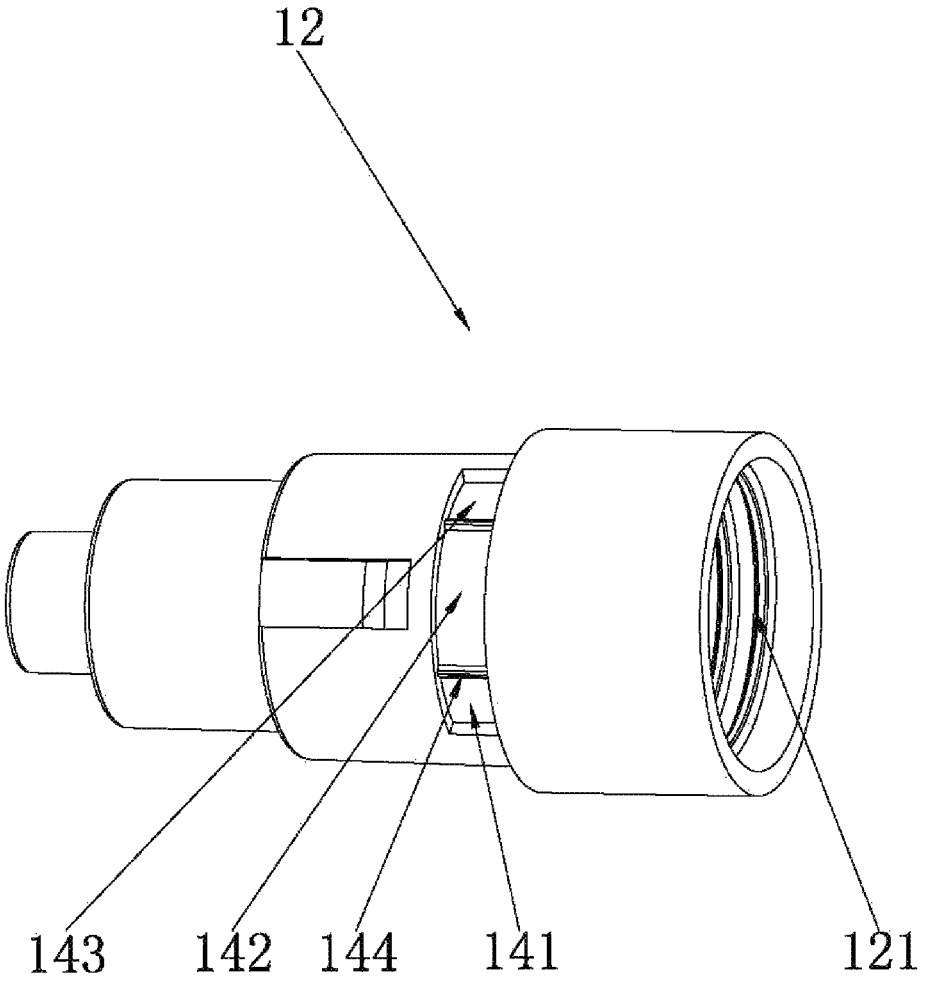
FIG. 3 is a perspective view of an upper receiving tube of the eye shadow pencil case according to the present invention.
Figure 4:
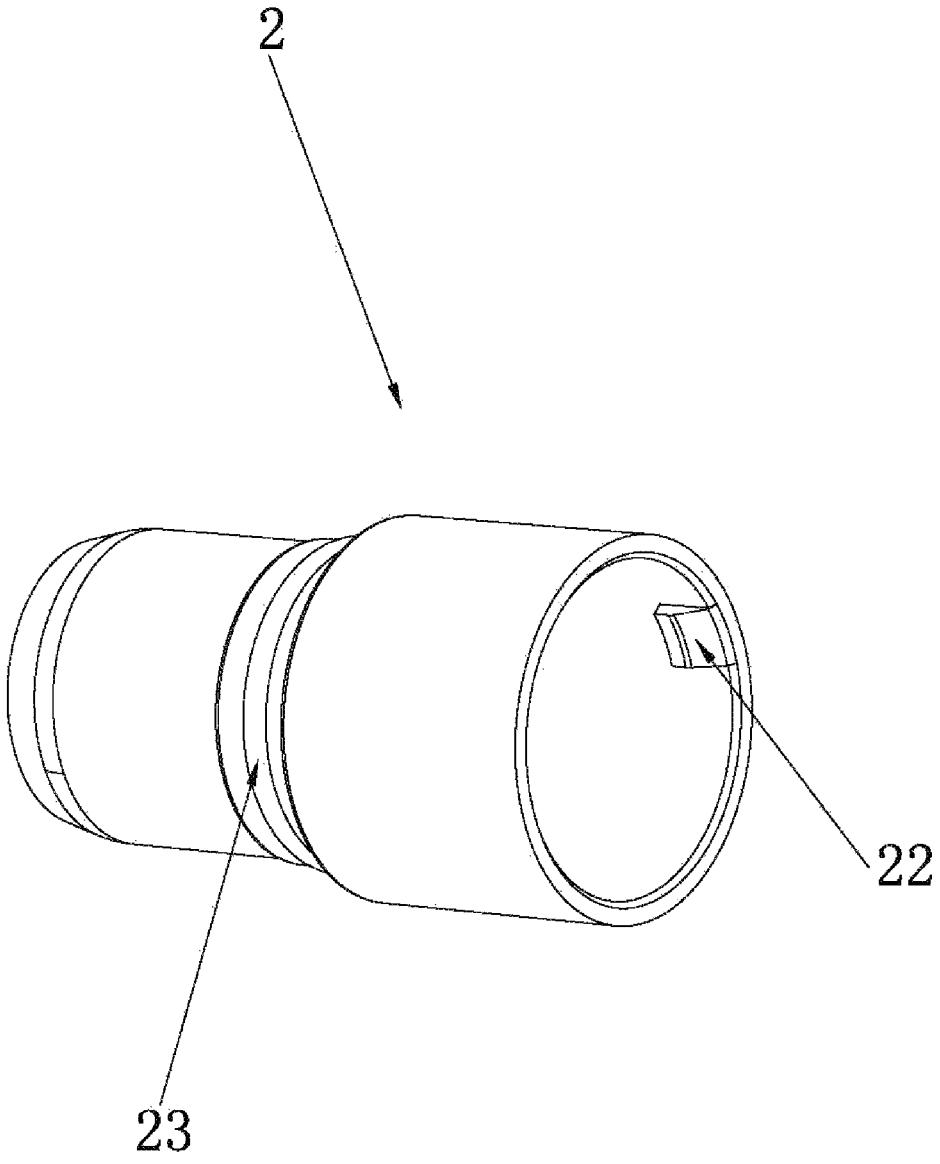
FIG. 4 is a perspective view of a rotatable control tube of the eye shadow pencil case according to the present invention.
Figure 5:
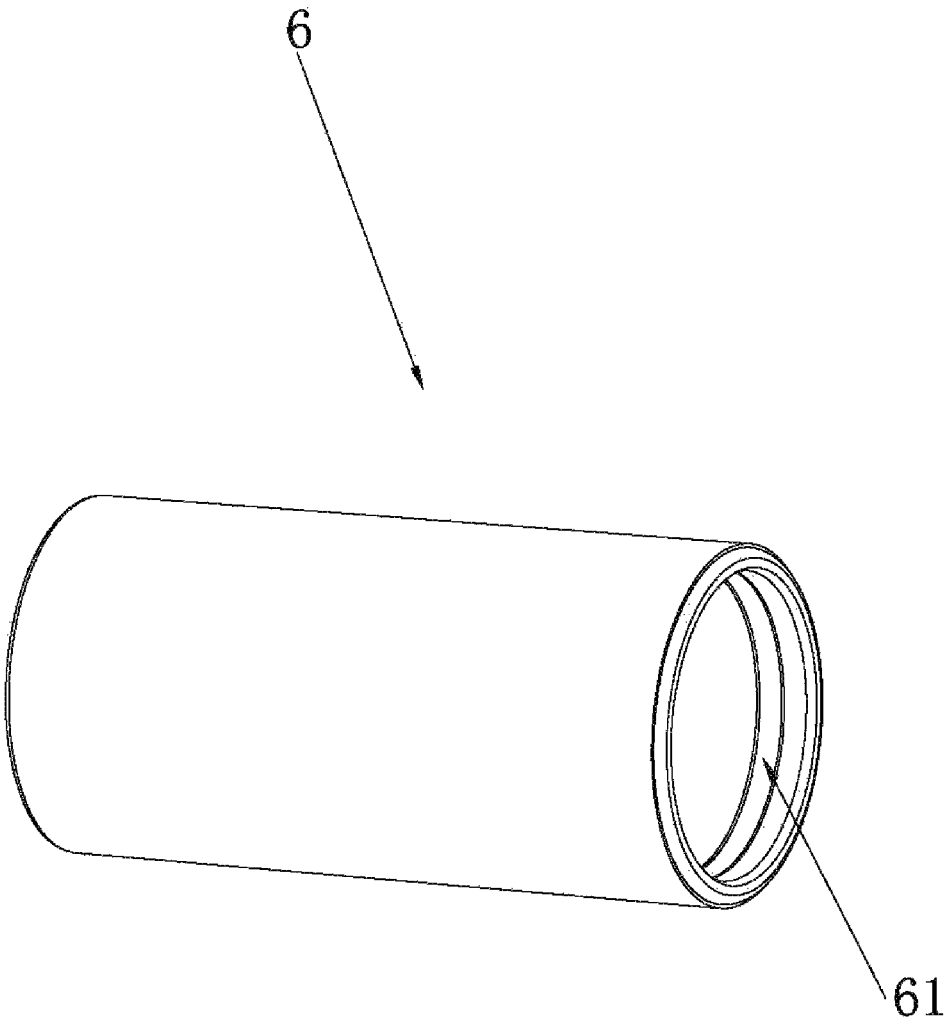
FIG. 5 is a perspective view of a cap of the eye shadow pencil case according to the present invention.

With reference to FIGS. 1-5, an eye shadow pencil case according to the present invention includes a container 1 adapted for receiving eye shadow, a rotatable control tube 2, and a makeup tool adapted for applying the eye shadow. The container 1 includes a top end having a first opening 13. The container 1 includes a sliding groove 14 in an intermediate portion of an outer periphery of the container 1. The rotatable control tube 2 includes a top end having a second opening 21. The rotatable control tube 2 further includes an inner periphery having a protrusion 22. The rotatable control tube 2 is mounted around the outer periphery of the container 1. The protrusion 22 of the rotatable control tube 2 is slideably received in the sliding groove 14 of the container 1.

The sliding groove 14 includes an open position and a closed position. The protrusion 22 of the rotatable control tube 2 slides in the sliding groove 14 when the rotatable control tube 2 is rotated. The second opening 21 of the rotatable control tube 2 is aligned with the first opening 13 of the container 1 when the protrusion 22 is in the open position. The second opening 21 of the rotatable control tube 2 is not aligned with the first opening 13 of the container 1 when the protrusion 22 is in the closed position. The makeup tool is mounted on the top end of the rotatable control tube 2.

In use, the rotatable control tube 2 is rotated, and the protrusion 22 on the inner periphery of the rotatable control tube 2 slides in the sliding groove 14 in the outer periphery of the container 1. When the rotatable control tube 2 is rotated to a position, the second opening 21 of the rotatable control tube 2 is aligned with the first opening 13 of the container 1. In this case, the eye shadow in the container 1 can flow from the first opening 13 and permeate into the makeup tool on the top end of the rotatable control tube 2. The makeup tool can directly contact the skin at an eye portion for makeup purposes. After makeup, the rotatable control tube 2 is rotated again until the second opening 21 of the rotatable control tube 2 is not aligned with the first opening 13 of the container 1. Thus, the first opening 13 is sealed to assure that the eye shadow in the container 1 will not flow out of the first opening 13 when not in use. By using the rotatable control tube 2 that can be rotated to open and close the first opening 13 of the container 1, it is assured that the eye shadow in the container 1 can flow out of the container 1 when in use and that the eye shadow in the container 1 will be retained in the sealed container 1 when not in use, permitting economical use of the eye shadow, which is a reasonable arrangement.

In this embodiment, the sliding groove 14 includes two ribs 144 separating the sliding groove 14 into a left sliding groove section 141, a middle sliding groove section 142, and a right sliding groove section 143. The second opening 21 of the rotatable control tube 2 is not aligned with the first opening 13 of the container 1 when the protrusion 22 of the rotatable control tube 2 is in the left sliding groove section 141 or the right sliding groove section 143. The second opening 21 of the rotatable control tube 2 is aligned with the first opening 13 of the container 1 when the protrusion 22 of the rotatable control tube 2 is in the middle sliding groove section 142.

When the protrusion 22 of the rotatable control tube 2 slides to the left sliding groove section 141 or the right sliding groove section 143, one of the ribs 144 stops a side of the protrusion 22, and the top end of the rotatable control tube 2 seals the first opening 13 of the container 1, forming a sealed structure to prevent the eye shadow from flowing out of the first opening 13 when not in use. When an external force is applied to rotate the rotatable control tube 2 again, the second opening 21 is aligned with the first opening 13 when the protrusion 22 slides to the middle sliding groove section 142. When the eye shadow pencil is being used, the eye shadow in the container 1 can flow out of the first opening 13 and permeate into the makeup tool mounted on the top end of the rotatable control tube 2. The makeup tool can directly contact the skin of the eye portion for makeup purposes.

In the form shown, the makeup tool is a sponge 3. The sponge 3 is mounted to the top end of the rotatable control tube 2. The sponge 3 has certain elasticity and is soft and fluffy such that the eye shadow can easily permeate into to the sponge 3. While doing makeup, the sponge 3 directly contacting the skin of the eye portion provides a comfort touch without injuring the skin of the eye portion.

Furthermore, a support 4 is mounted between the sponge 3 and the rotatable control tube 2. The support 4 supports the sponge 3. The support 4 includes an upper end having a plurality of notches 41. Since the sponge 3 is soft and fluffy, the support 4 mounted between the sponge 3 and the rotatable control tube 2 supports the sponge 3 during makeup. Thus, even though an external force is applied during makeup, the sponge 3 can maintain its shape without great deformation adversely affecting the makeup. Furthermore, notches 41 in the upper end of the support 4 permit the eye shadow from the container 1 to smoothly flow through the openings 41 and, thus, permeate into the sponge 3. The structure is simple, and the utility is good.

In this embodiment, the container 1 includes an upper receiving tube 12 and a lower receiving tube 11. The upper receiving tube 12 includes the sliding groove 14 and the second opening 21. The upper receiving tube 12 includes a lower end having an inner thread 121. The lower receiving tube 11 includes an upper end having an outer thread 111. The inner thread 121 is threadedly engaged with the outer thread 111. The lower receiving tube 11 and the upper receiving tube 12 can be detached from each other through rotation. Namely, in a case that amount of the eye shadow in the container 1 is reduced or is used up, the lower receiving tube 11 is rotated and detached, and new eye shadow can be filled into the lower receiving tube 11. Next, the lower receiving tube 11 and the upper receiving tube 12 are connected to each other by rotation. By this technical solution, the eye shadow pencil case can be used for a long period of time, which is more eco-friendly than conventional disposable eye shadow pencil cases and saves the costs.

Furthermore, a plug 5 can be mounted between the upper receiving tube 12 and the lower receiving tube 11 for sealing purposes. Since the upper receiving tube 12 and the lower receiving tube 11 are threadedly engaged with each other and since the eye shadow is a fluid, the sealing therebetween will degrade after repeated detachment and assembly between the upper receiving tube 12 and the lower receiving tube 11. In this case, the plug 5 provides a sealing effect to seal a connection area between the upper receiving tube 12 and the lower receiving tube 11, assuring that the eye shadow will not leak via the connection area between the upper receiving tube 12 and the lower receiving tube 11.

In this embodiment, a cap 6 is mounted around an outer periphery of the rotatable control tube 2. After use of the eye shadow pencil case, the cap 6 is mounted around the rotatable control tube 2 to allow easy carriage while providing the sponge 3 on the top end of the rotatable control tube 2 with dustproof and waterproof effects. The arrangement is durable and reasonable and provides utility.

In the form shown, the cap 6 includes an inner periphery having an annular groove 61, and the outer periphery of the rotatable control tube 2 includes an annular rib 23. The annular rib 23 of the rotatable control tube 2 is engaged in the annular groove 61 of the cap 6 when the cap 6 is mounted around the rotatable control tube 2. This arrangement is reasonable and provides stable connection, such that cap 6 is less likely to fall even under normal impact.

Although specific embodiments have been illustrated and described, numerous modifications and variations are still possible without departing from the scope of the invention. The scope of the invention is limited by the accompanying claims.

The invention claimed is:

1. An eye shadow pencil case comprising a container (1) adapted for receiving eye shadow, a rotatable control tube (2), and a makeup tool adapted for applying the eye shadow, with the container (1) including a top end having a first opening (13), with the container (1) including a sliding groove (14) in an intermediate portion of an outer periphery of the container (1), with the rotatable control tube (2) including a top end having a second opening (21), with the rotatable control tube (2) further including an inner periphery having a protrusion (22), with the protrusion (22) of the rotatable control tube (2) slideably received in the sliding groove (14) of the container (1), with the sliding groove (14) including an open position and a closed position, with the protrusion (22) of the rotatable control tube (2) sliding in the sliding groove (14) when the rotatable control tube (2) is rotated, with the second opening (21) of the rotatable control tube (2) aligned with the first opening (13) of the container (1) when the protrusion (22) is in the open position, with the second opening (21) of the rotatable control tube (2) not aligned with the first opening (13) of the container (1) when the protrusion (22) is in the closed position, and with the makeup tool mounted on the top end of the rotatable control tube (2) with the sliding groove (14) including two ribs (144) separating the sliding groove (14) into a left sliding groove section (141), a middle sliding groove section (142), and a right sliding groove section (143), with the second opening (21) of the rotatable control tube (2) not aligned with the first opening (13) of the container (1) when the protrusion (22) of the rotatable control tube (2) is in the left sliding groove section (141) or the right sliding groove section (143), and with the second opening (21) of the rotatable control tube (2) aligned with the first opening (13) of the container (1) when the protrusion (22) of the rotatable control tube (2) is in the middle sliding groove section (142).

2. The eye shadow pencil case claimed in claim 1, with the makeup tool being a sponge (3), and with the sponge (3) mounted to the top end of the rotatable control tube (2).

3. The eye shadow pencil case as claimed in claim 2, further comprising: a support (4) mounted between the sponge (3) and the rotatable control tube (2), with the support (4) supporting the sponge (3), and with the support (4) including an upper end having a plurality of notches (41).

4. The eye shadow pencil case as claimed in claim 1, with the container (1) including an upper receiving tube (12) and a lower receiving tube (11), with the upper receiving tube (12) including the sliding groove (14) and the second opening (21), with the upper receiving tube (12) including a lower end having an inner thread (121), with the lower receiving tube (11) including an upper end having an outer thread (111), and with the inner thread (121) threadedly engaged with the outer thread (111).

5. The eye shadow pencil case as claimed in claim 4, further comprising: a plug (5) mounted between the upper receiving tube (12) and the lower receiving tube (11), with the plug (5) sealing a connection area between the upper receiving tube (12) and the lower receiving tube (11).

6. The eye shadow pencil case as claimed in claim 1, further comprising: a cap (6), with the cap (6) mounted around an outer periphery of the rotatable control tube (2).

7. The eye shadow pencil case claimed in claim 6, with the cap (6) including an inner periphery having an annular groove (61), with the outer periphery of the rotatable control tube (2) including an annular rib (23), with the annular rib (23) of the rotatable control tube (2) engaged in the annular groove (61) of the cap (6) when the cap (6) is mounted around the rotatable control tube (2).

* * * * *